US005543783A

United States Patent [19]

Clark et al.

[11] Patent Number: 5,543,783

[45] Date of Patent: Aug. 6, 1996

[54] GLASS BREAK DETECTOR AND A METHOD THEREFOR

[75] Inventors: Frank B. Clark; Kenneth T. Lewis, both of Longview, Tex.

[73] Assignee: Caddx-Caddi Controls, Inc., Gladewater, Tex.

[21] Appl. No.: 246,584

[22] Filed: May 20, 1994

[51] Int. Cl.[6] ..... G08B 13/00

[52] U.S. Cl. ..... 340/550; 340/566; 340/693; 73/587; 73/658

[58] Field of Search ..... 340/566, 550, 340/565, 815.46, 693; 310/335; 73/587, 658; 181/176

[56] References Cited

U.S. PATENT DOCUMENTS

| | | | |
|---|---|---|---|
| 3,863,250 | 1/1975 | McCluskey, Jr. | 340/274 |
| 3,889,250 | 6/1975 | Solomon | 340/274 |
| 3,946,377 | 3/1976 | Zetting | 340/274 |
| 4,091,660 | 5/1978 | Yanagi | 73/658 |
| 4,134,109 | 1/1979 | McCormick et al. | 340/566 |
| 4,260,928 | 4/1981 | Salem | 310/335 |
| 4,359,669 | 11/1982 | Anderson | 340/815.46 |
| 4,668,941 | 5/1987 | Davenport et al. | 340/550 |
| 4,738,137 | 4/1988 | Sugg et al. | 73/587 |
| 4,745,398 | 5/1988 | Abel et al. | 340/500 |
| 4,837,558 | 6/1989 | Abel et al. | 340/550 |
| 4,845,464 | 7/1989 | Drori et al. | 340/566 |
| 4,853,677 | 8/1989 | Yarbrough et al. | 340/566 |
| 4,882,567 | 11/1989 | Johnson | 340/522 |
| 5,109,216 | 4/1992 | Yarbrough et al. | 340/544 |
| 5,117,220 | 5/1992 | Marino et al. | 340/550 |
| 5,192,931 | 3/1993 | Smith et al. | 340/550 |
| 5,194,848 | 3/1993 | Kerr | 340/566 |
| 5,323,141 | 6/1994 | Petek | 340/566 |

OTHER PUBLICATIONS

Blue Grass Electronics Inc., "Installation And Operating Instructions For The BGE–PN25", Sep. 1992.

Litton, "Terminus AudioLogic Glass–Break Detector: Installation and Operating Instructions", Jan. 1993.

Sentrol, Inc., "SHATTERPRO Installation Instructions: Model 5810", 1992.

IntelliSense Security Systems, Inc., "FlexGuard Dual Technology Glass–Break Detector: Installation Instructions", 1991.

Microchip Technology Inc., "PIC 16C71: 8–Bit CMOS EPROM Microcontroller with A/D Converter", 1992.

Harry F. Olsen, Ph.D., "Acoustical Engineering", Oct., 1964, p. 24.

*Primary Examiner*—Brent A. Swarthout
*Assistant Examiner*—Bejamin C. Lee
*Attorney, Agent, or Firm*—Jenkens & Gilchrist, P.C.

[57] ABSTRACT

An acoustic transducer has an output which is fed through a preamplifier to a multiple of parallel filters. Each parallel filter passes a band of signals having frequencies within a predetermined range of frequencies. Each band of signals is converted from analog to digital and input to a signal processing unit. The peak amplitude value and the average value of the output from each parallel filter is determined. The peak amplitude value and average amplitude value are compared to determine if a pretrip condition occurs. If a pretrip condition occurs, the average value is saved and compared with the peak amplitude value for a select number of time periods to determine if a trip condition exists. A special test can be used which alters the number of time periods used in determining if a trip condition exists, based on a comparison the peak amplitude value between two of the bands. An alarm condition is generated when trip conditions occur for each of the bands of signals within a second predetermined time period.

27 Claims, 7 Drawing Sheets

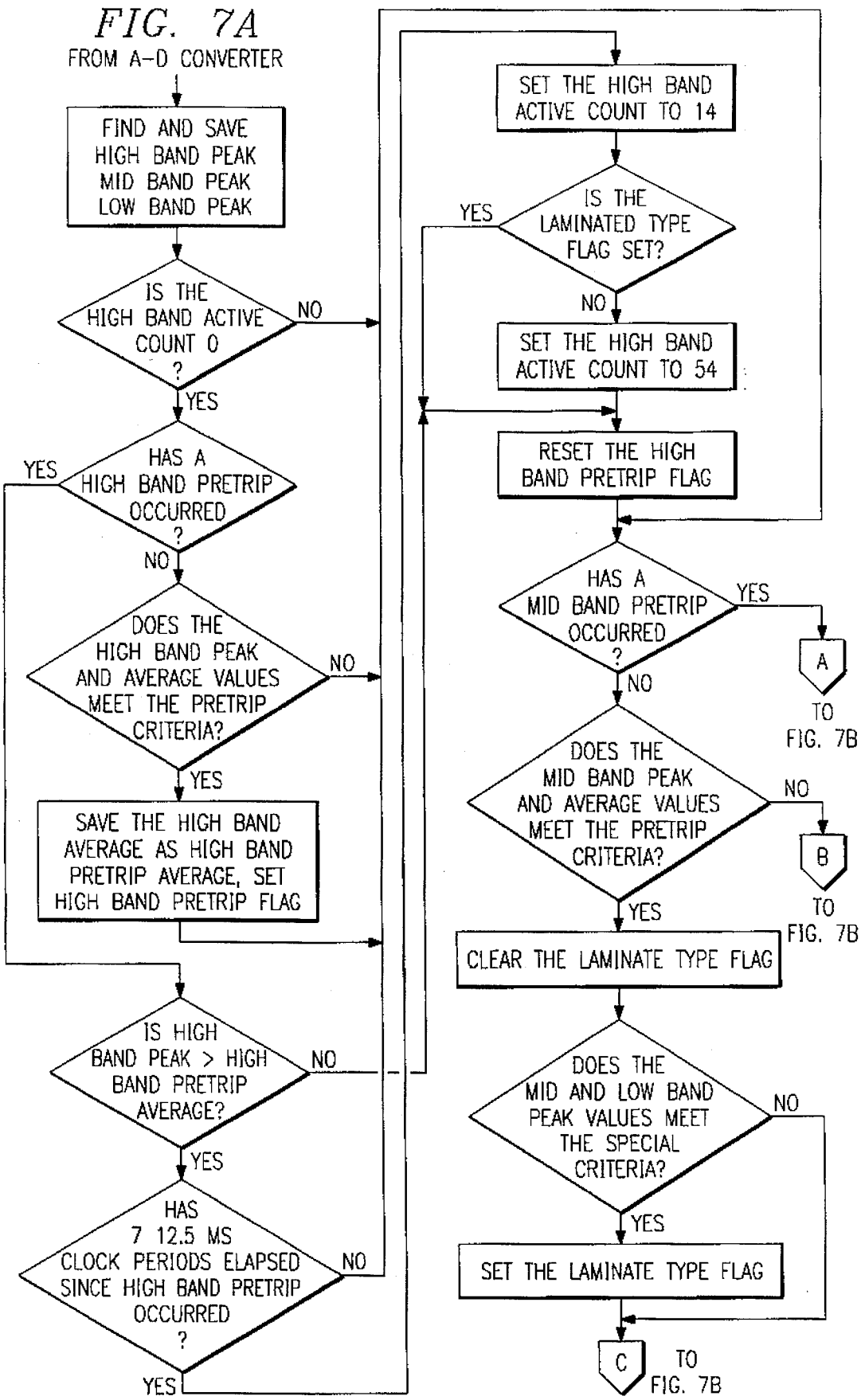
FIG. 7A
FROM A-D CONVERTER
FIND AND SAVE HIGH BAND PEAK MID BAND PEAK LOW BAND PEAK
IS THE HIGH BAND ACTIVE COUNT 0 ?
NO
YES
HAS A HIGH BAND PRETRIP OCCURRED ?
YES
NO
DOES THE HIGH BAND PEAK AND AVERAGE VALUES MEET THE PRETRIP CRITERIA?
NO
YES
SAVE THE HIGH BAND AVERAGE AS HIGH BAND PRETRIP AVERAGE, SET HIGH BAND PRETRIP FLAG
IS HIGH BAND PEAK > HIGH BAND PRETRIP AVERAGE?
NO
YES
HAS 7 12.5 MS CLOCK PERIODS ELAPSED SINCE HIGH BAND PRETRIP OCCURRED ?
NO
YES
SET THE HIGH BAND ACTIVE COUNT TO 14
IS THE LAMINATED TYPE FLAG SET?
YES
NO
SET THE HIGH BAND ACTIVE COUNT TO 54
RESET THE HIGH BAND PRETRIP FLAG
HAS A MID BAND PRETRIP OCCURRED ?
YES
A
TO FIG. 7B
NO
DOES THE MID BAND PEAK AND AVERAGE VALUES MEET THE PRETRIP CRITERIA?
NO
B
TO FIG. 7B
YES
CLEAR THE LAMINATE TYPE FLAG
DOES THE MID AND LOW BAND PEAK VALUES MEET THE SPECIAL CRITERIA?
NO
YES
SET THE LAMINATE TYPE FLAG
C
TO FIG. 7B

GLASS BREAK DETECTOR AND A METHOD THEREFOR

BACKGROUND OF THE INVENTION

1. Field of the Invention

The invention relates to glass break detectors for alarm systems. More particularly, but not by way of limitation, this invention relates to multiple filter glass break detectors for alarm systems.

2. Description of the Related Art

It has become common to use alarm systems for providing security to commercial buildings, homes, automobiles and other areas. Many of these structures have windows which cause more of a problem than do doors and walls for an alarm system which provides security for the structure. In order to overcome the problems caused by the windows, glass break detectors have been developed.

Some of the types of glass break detectors include active detectors, physical vibration detectors and acoustic detectors. Active glass break detectors send a specific frequency energy to or through the glass and monitors the return of that energy for changes therein to determine if the glass has been broken. Physical vibration detectors have a sensing unit mounted directly on the glass and monitor the glass for vibrational energies which indicate that the glass has been broken. Acoustic detectors monitor sound waves for specific frequencies and amplitudes which relate to frequencies and amplitudes of broken glass.

Generally, glass break detectors sense the higher level of energy briefly emitted by the breaking of glass. However, background noise, such as aircraft flying nearby or other loud sources of noise, can produce levels of energy which the glass break detectors can mistakenly sense as breaking glass. To reduce false alarms caused by background noise, glass break detectors have incorporated filters for selectively passing frequencies resulting from breaking glass.

By selecting a single frequency produced by breaking glass, the glass break detector could be mounted in a location, or general ambient conditions could be such that, the glass break detector would have more of a tendency to false alarm because the single frequency or band can occur in sounds other than breaking glass. Glass break detectors have overcome this deficiency by using multiple filters to provide amplitude monitoring for a plurality of frequencies. These plurality of frequencies are selected according to the most critical frequencies produced by breaking glass.

The amplitude of the frequencies selected are compared to threshold values to determine if the noise produced resulted from breaking glass. These threshold values are predetermined and preset values. Because these values are predetermined and preset, they are unable to compensate for varying ambient background noise conditions or the different critical frequencies of various types of breaking glass. Each type of glass has its own unique frequencies and amplitudes that it produces when it breaks. Therefore, the preset threshold values of the prior art glass detectors must be uniquely set for the type of glass that the glass break detector is to sense. This presents a limitation for each unique glass break detector on its application to types of glass.

In order to set threshold values, it is necessary to determine the critical frequencies and amplitudes of the glass that is being monitored. In prior art glass break detectors, the critical frequencies and amplitudes of the glass to be sensed for breakage was monitored by a sensing device which is unrelated to the actual glass break detector. By using an external device to monitor the characteristics of breaking glass, the threshold values are set in the glass break detector without regard to the individual characteristics of how the glass break detectors senses the characteristics of the glass or how the external detection device senses the characteristics of breaking glass. This blind setting of threshold values leaves an uncertainty as to what the glass break detector is actually sensing or where the glass break detector is actually set in regard to the threshold value.

In sensing the select frequencies of breaking glass, the prior art glass break detectors use comparators that continuously monitor each filter. If, for processing purposes, it is desired to use an analog-to-digital converter for changing the frequency data to digital form, this would require multiple analog-to-digital converters. The use of multiple analog-to-digital converters presents a problem of complex and more expensive circuitry.

The passive acoustic glass break detectors depend on sensing acoustic noise transmitted from the breaking glass across the ambient conditions and to an acoustic sensor. Factors in the ambient conditions such as distance from the breaking glass to the glass break sensor can cause the acoustic noise transmitted by a breaking glass to diminish such that the sensor is unable to pick up enough noise signal for the glass break detector circuitry to sense the breaking glass. One means of compensating for diminished acoustic signals is by providing a preamp immediately after the sensor for amplifying the level of sound sensed. However, this requires extra power and circuitry for the glass break detector.

For the foregoing reasons, there is a need for a glass break detector which can reduce the number of false alarms but yet still pick up breaking glass with more reliability, does not need to rely on preset threshold values for determining when glass has been broken and can monitor and display what the glass break detector actually senses and at what threshold that the glass break detector triggers.

SUMMARY OF THE INVENTION

This invention provides apparatus and method for improved glass break detection for performing the complex task of identifying multiple frequencies associated with breaking glass while ignoring similar sounds which are present in many applications.

The glass break detector comprises an acoustic transducer whose output is fed through a preamplifier to a multiple of parallel filters. Each parallel filter passes a band of signals having frequencies within a predetermined range of frequencies. Each band of signals is converted from analog to digital and input to a signal processing unit which determines if the combination of levels of signals at various frequencies from the filters are to be considered an indication of breaking glass and to sound an alarm when the breaking of glass occurs. A unique signal processing algorithm is used so adjustments are not necessary for various types and sizes of glass.

A method is provided whereby the various sounds associated with breaking glass are detected and fed to a multiple of parallel filters. The output of each parallel filter comprises a band of signals having frequencies within a predetermined range of frequencies and are input to a signal processing unit. The peak amplitude value and the average value of the output from each parallel filter is determined. The peak amplitude value is compared to the average value to determine if a pretrip condition exists. A pretrip condition is generated for a band of signals when the compared values for a band of signals meet preset conditions. When a pretrip condition occurs for a band of signals, the average value for a band is saved and compared with the peak amplitude value for a specified number of time periods to determine if a trip condition exists. A special test can be used which alters the specific number of time periods that are used to determine if a trip condition exists, based on a comparison of the peak amplitude values between two of the bands. An alarm indicative of breaking glass is sounded when the trip condition for each band of signals has been generated within a second predetermined time period.

BRIEF DESCRIPTION OF THE DRAWINGS

For a more complete understanding of the present invention and for other advantages and features thereof, reference may now be had to the following detailed description of a presently preferred embodiment thereof in connection with the accompanying drawings, wherein like reference numerals have been applied to like elements, in which:

FIG. 7A–C are is a simplified flow chart illustrating the overall programming steps of the present invention.

DESCRIPTION OF THE PREFERRED EMBODIMENT

Figure 1:
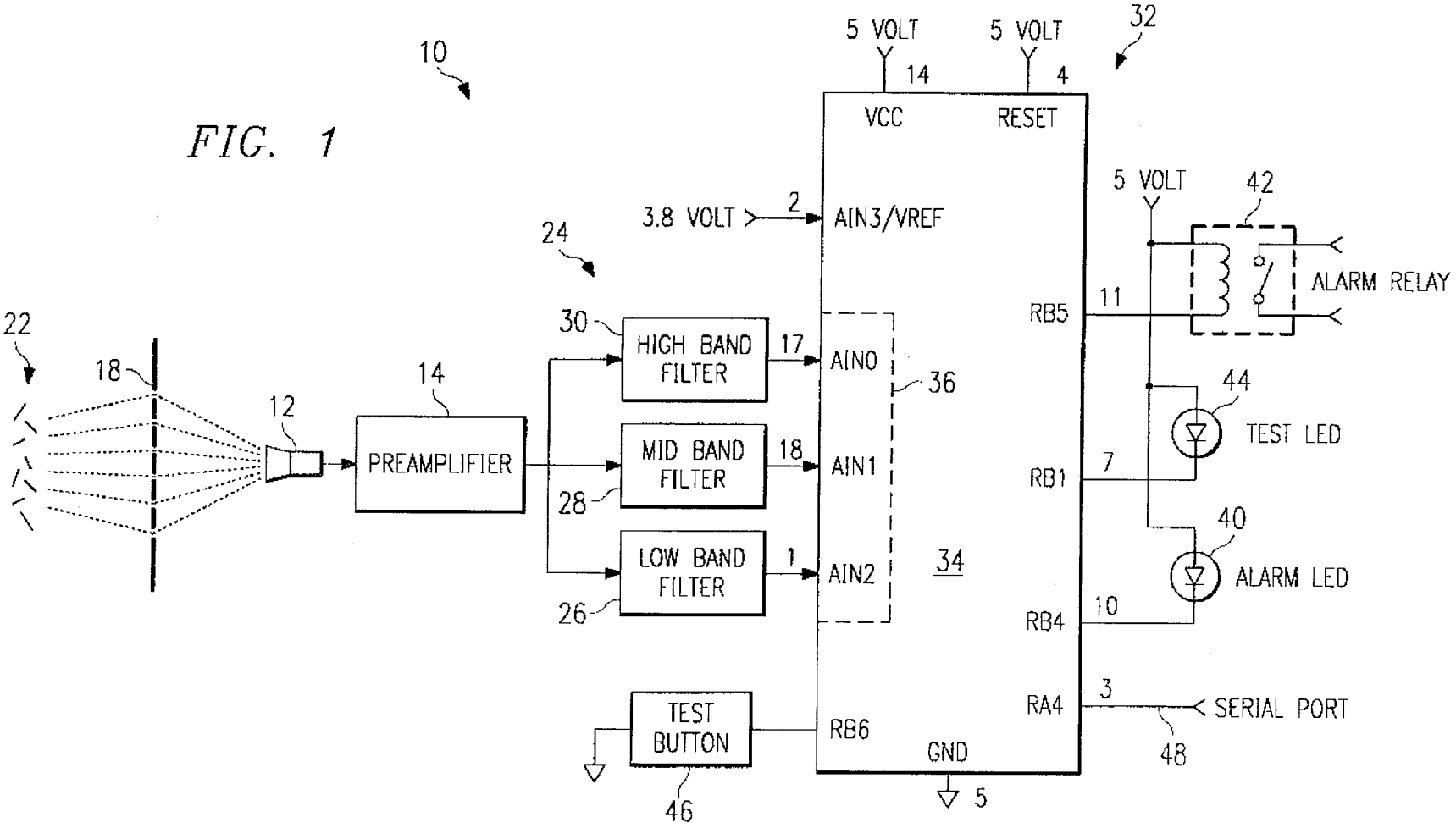
FIG. 1 is a simplified block diagram of a glass break detector that is constructed in accordance with the preset invention.
Figure 2:
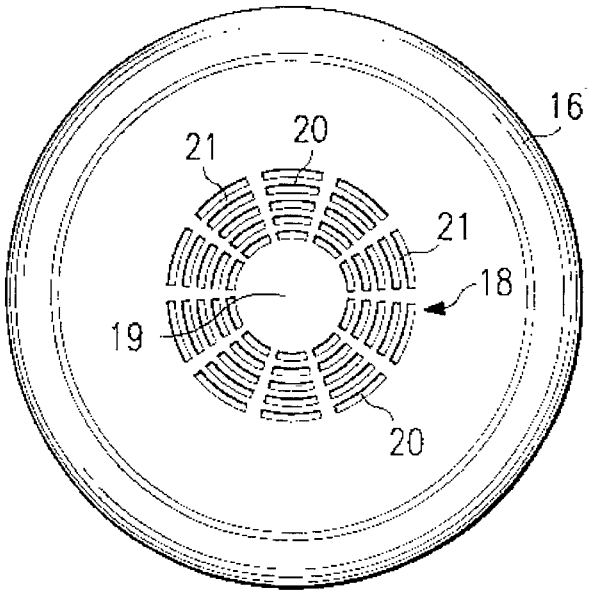
FIG. 2 is a simplified front elevational view of the housing for the present invention.
Figure 3:
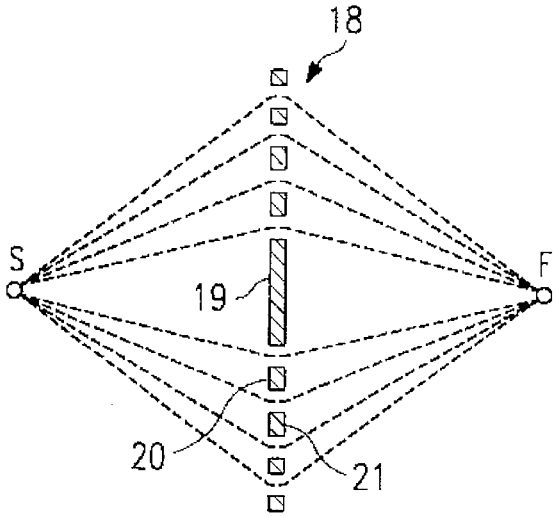
FIG. 3 is a simplified cross-sectional view of the grill of the housing showing the focusing effect thereof.

Referring to the drawings and FIGS. 1–3 in particular, shown therein and generally designated by the reference character 10 is a glass break detector constructed in accordance with the present invention. As illustrated, glass break detector 10 includes an acoustic transducer 12, such as a wide band electret microphone, whose output is fed into a preamplifier 14. In the preferred embodiment, preamplifier 14 comprises an op-amp with a gain of about three.

Glass break detector 10 is mounted in a generally circular housing 16 having a front portion comprising a grill 18 whose design of concentric circular openings or air passageways 20 and concentric circular portions 21 of housing 16 placed generally in the center of the front portion of housing 16 tend to bend the sound waves from breaking glass (source S in FIG. 3) and direct more of the sound waves into the acoustic transducer 12 which is mounted behind grill 18 at the focus point F (see FIG. 3). The positioning of the grill 18 in the circular front portion of housing 16 and the shape of the grill 18 tend to act like a parabolic mirror with regard to the sound waves and provides the effect of amplifying the sound waves from breaking glass 22. For best results, housing 16 is mounted such that grill 18 will have a line-of-sight view of all glass being protected.

Figure 4:
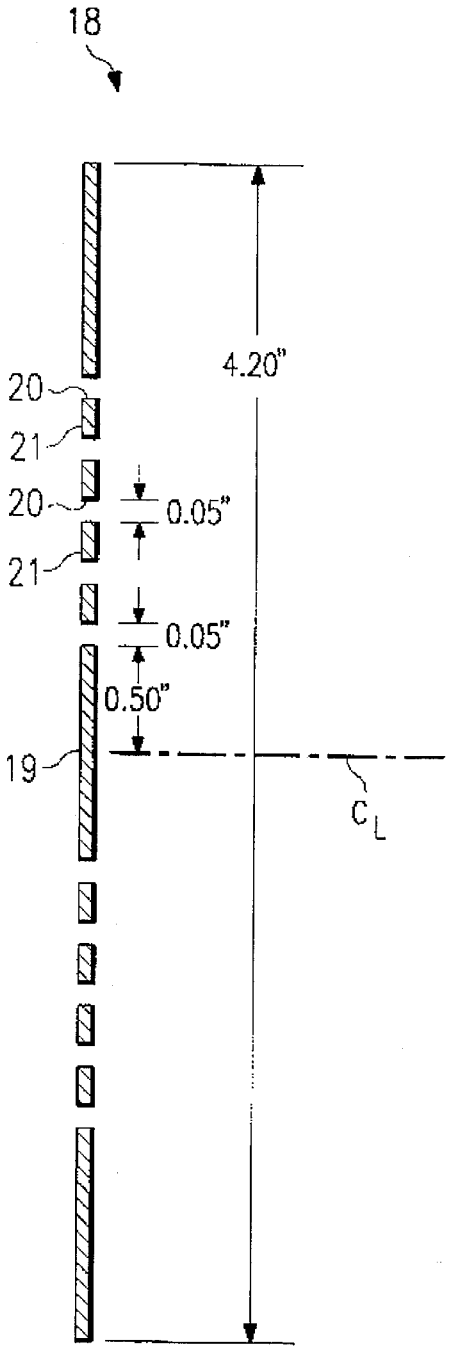
FIG. 4 is a simplified enlarged cross-sectional view of the grill of the housing showing the dimensions there.

The dimensions and structure of the front portion of housing 16 is critical in obtaining the best operation of detecting the breaking glass 22. With reference to FIG. 4, the diameter of the central disc-like portion 19 of grill 18 is 0.80 inches. The inner radius of the first concentric circular opening or air passageway 20 from centerline $C_1$ is 0.50 inches. The radial width of each of the concentric circular openings 20 and of each of the concentric circular portions 21 of housing 16 is 0.05 inches. In the preferred embodiment, there are five concentric circular openings or air passageways 20 separated by four concentric circular portions 21 of housing 16. The outer diameter of housing 16 is 4.20 inches and housing 16 has a depth of 0.77 inches.

The amplified signal from preamplifier 14 is fed to a multiple of parallel filters 24. In the preferred embodiment, the multiple of parallel filters 24 include a low band filter 26, a mid band filter 28 and a high band filter 30. The low band filter 26 is a bandpass type filter which is set to a peak gain of about ten at a center frequency of about 20 hertz (hz). This low band of frequencies is used to detect or see the barely audible sound wave that is created during the initial impact of an object with the glass. The mid band filter 28 is a bandpass type filter which is set to a peak gain of about nine at a center frequency of about 4500 hz. This mid band of frequencies has long been known to contain the largest amount of volume during the actual breaking of glass. The high band filter 30 is a high-pass type of filter with a peak gain of about eleven with a cutoff at about 15000 hz. This high band of frequencies includes ultrasonic frequencies so the sound of glass pieces rubbing against one another is detected in this band.

While each of the bands might detect the breaking of framed glass, it would not be wise or reliable to rely on the use of any one of the bands by itself. For example, the low band could detect the sound from someone knocking on a door. The mid band could detect sounds from a dish being dropped and broken or a bird chirping. The high band could detect sounds from keys being jingled. So it is very important to have all of the three bands active at all times and have them activated nearly simultaneously.

The outputs from the individual filters of the multiple of parallel filters 24 are input to signal processing means 32. In the preferred embodiment, signal processing means 32 includes microprocessor 34 which includes an eight bit analog-to-digital (A/D) converter 36 which receives the outputs of the parallel filters. The particular microprocessor used in the present invention is an 8-bit CMOS EPROM Microcontroller with an on-chip A/D Converter from Microchip Technology Incorporated. It will be appreciated that similar microprocessors could be used in carrying out the concept and implementation of the present invention.

Units or items which are connected to the inputs and outputs of microprocessor 34 include a red light (LED) 40, an alarm relay 42, a green light (LED) 44 and a test button 46 which are used primarily during the test and setup phases. A real time serial port 48 is also used in the present invention for production purposes and special diagnostics.

During operation of the present invention, the glass break detector 10 will monitor acoustic sounds in the area to be monitored for the breaking of glass. Any sound of breaking glass will be picked up by acoustic transducer 12 which passes an analog output signal to preamplifier 14. The amplified signal from preamplifier 14 is fed to the low band filter 26, the mid band filter 28 and the high band filter 30.

The filtered output from the three filters are input to the A/D converter 36 of microprocessor 34. The A/D converter 36 will convert the analog signal levels from each of the three filters into digital signals representing each of those analog signal levels. A software program within microprocessor 34 will receive the digital signals from the A/D converter 36 and will determine if the combination of levels at various frequencies present at the inputs are to be considered an alarm.

In a preferred embodiment, the A/D converter 36 will convert the analog signals from the three filters into three digital signals having a value of 0–127. For each of the three digital signals, a zero reading would represent a sound wave pressure of zero microbars in the frequency band of the respective filter. For the low band filter 26, a digital signal of 127 would represent a sound wave pressure of about 99.8 microbars at the microphone 12 for the frequency band of the low band filter 26. For the mid band filter 28, a digital signal of 127 would represent a sound wave pressure of about 110.9 microbars at the microphone 12 for the frequency band of the mid band filter 28. For the high band filter 30, a digital signal of 127 would represent a sound wave pressure of about 91.9 microbars at the microphone 12 for the frequency band of the high band filter 30. For each of the three filters, the digital signal range from 0 to 127 is a linear representation of the sound pressure at the microphones for the frequency band of the respective filters. Although the ranges and values illustrated herein are characterized as being for a preferred embodiment, they are not to be considered limiting of the present invention. It will be appreciated by those skilled in the art that other ranges and values could be used for the same filter frequency bands or for different filter bands.

Figure 5:
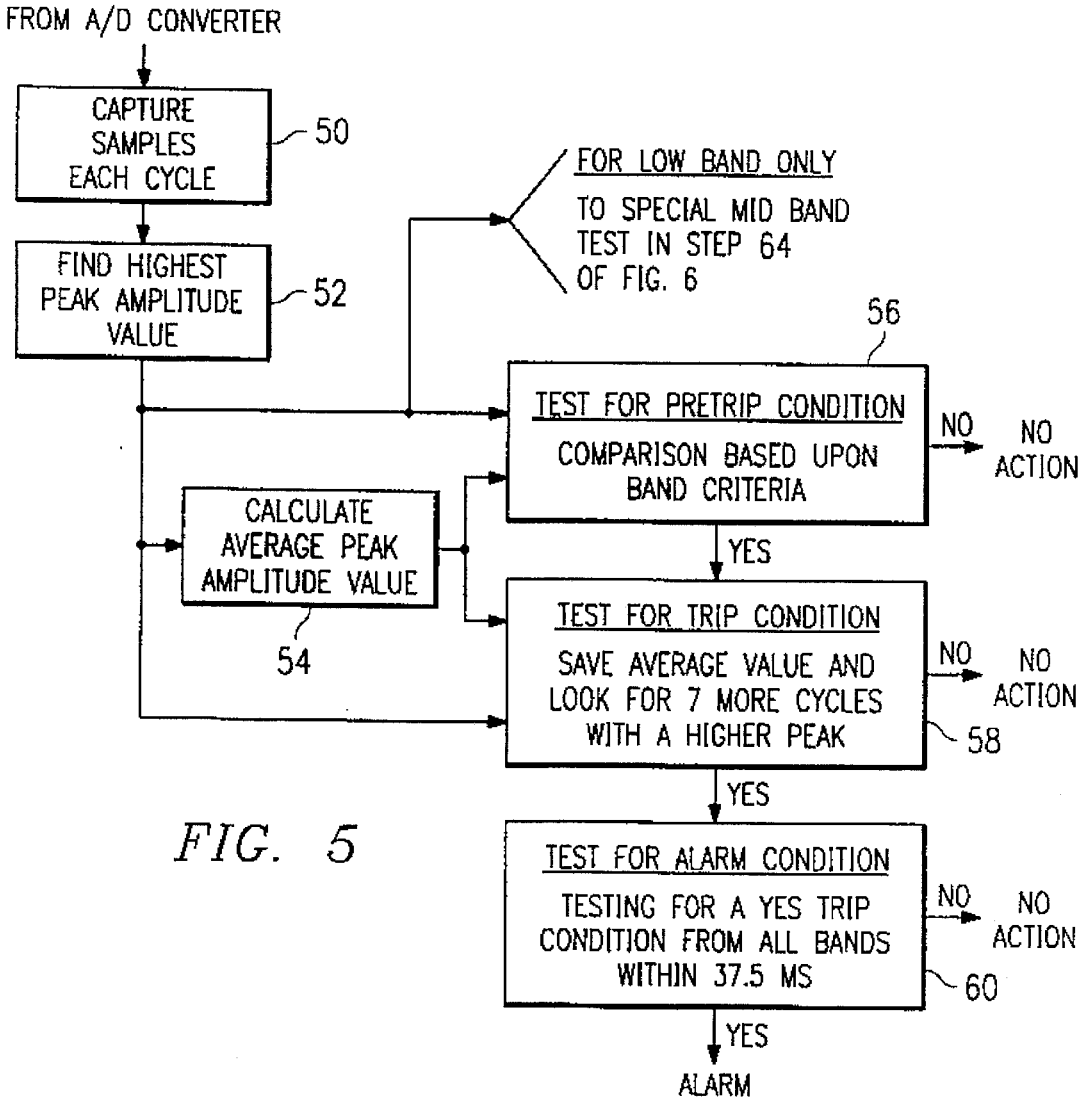
FIG. 5 is a simplified flow chart illustrating the logic steps performed in determining a portion of the pretrip and trip conditions of the present invention.

With reference to FIG. 5, the steps or flow associated with the low band or the high band pretrip and trip conditions are the same and will be discussed. Each of the steps or flow in FIG. 5 are performed every clock cycle, which is 12.5 milliseconds (ms) in the preferred embodiment described below. At step 50, the outputs from the A/D converter 36 for the low band filter 26 and the high band filter 30 are sampled every clock cycle. Sixty four samples of the low band signal and one hundred twenty eight samples of the high band signal are captured in step 50 each clock cycle. In step 52, the highest peak amplitude value (digital) is isolated from the samples from step 50 for each of the bands. In step 54, an average peak amplitude value is calculated for each of the bands from the highest peak amplitudes sent to step 54 each cycle from step 52. Although FIG. 5 shows the average peak amplitude value in step 54 as being calculated just prior to the later testing steps, in a preferred embodiment the average peak amplitude value could be an average peak amplitude value calculated in the previous cycle.

Referring still to FIG. 5, the outputs from steps 52 and 54 are compared in step 56 to determine if a pretrip condition (YES) exists for the filter. For a pretrip condition (YES) to occur in the step 56 for a low band filter having a sound pressure range as illustrated in the preferred embodiment above, the low band highest peak amplitude value is to be greater than about 29 and at least about 2 times greater than the low band average peak value. If those conditions occur, that constitutes a pretrip condition (YES) for the low band. For a pretrip condition (YES) to occur in the step 56 for a high band filter having a sound pressure range as illustrated in the preferred embodiment above, the high band highest peak amplitude value is to be greater than about 24 and at least about a count of 10 greater than the high band average peak amplitude value. If those conditions occur, that constitutes a pretrip condition (YES) for the high band.

Still referring to FIG. 5, when the pretrip condition (YES) occurs in the step 56 for a particular band, step 58 will store the current average peak amplitude value for that band from the step 54 and a count or test is set in a trip condition test in step 58 to look for about 7 more clock cycles where the band's highest peak amplitude value is greater than the band's average peak value stored from step 54. If step 58 finds the correct sequential number of trip conditions, a YES trip signal is then sent to step 60.

Figure 6:
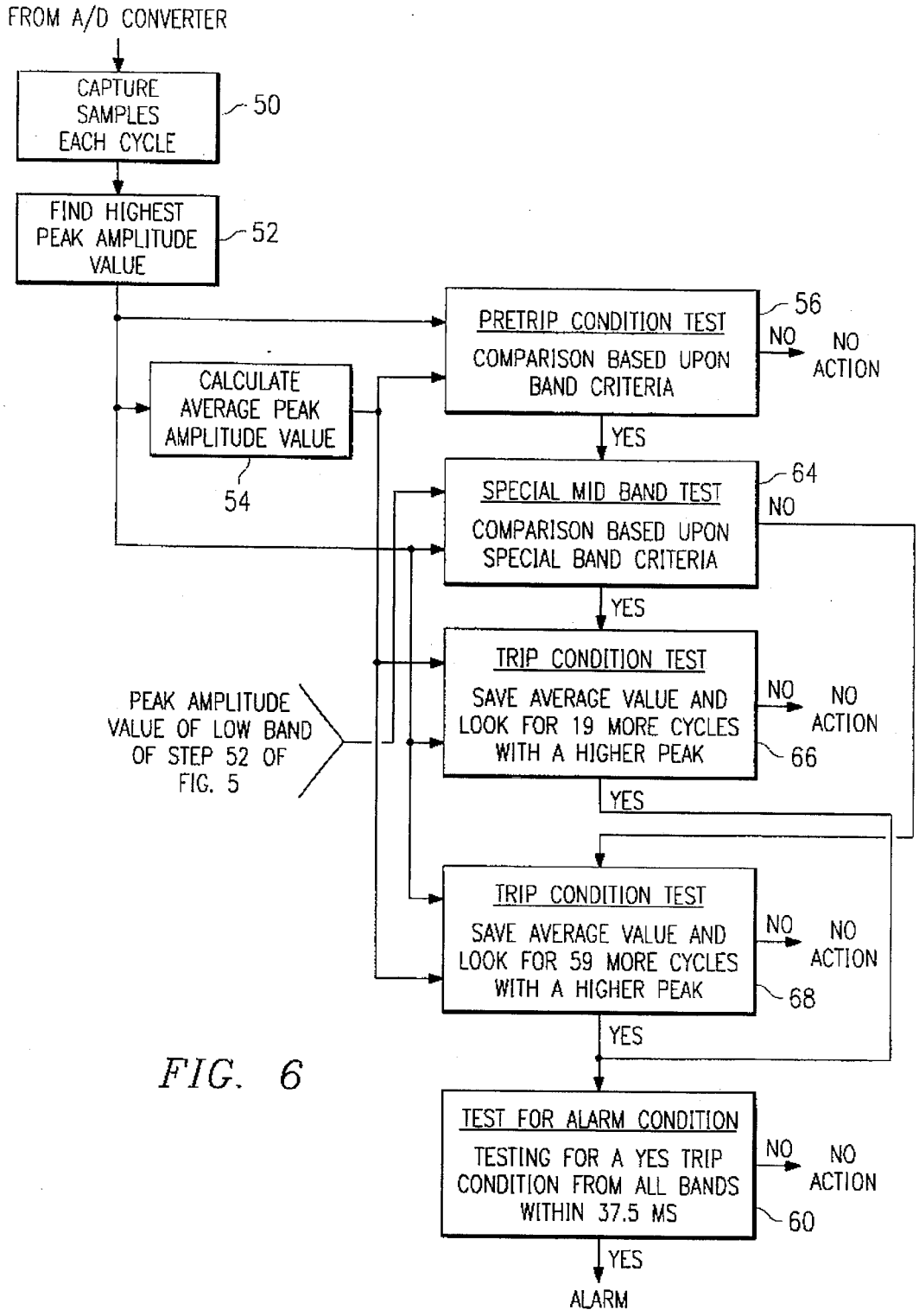
FIG. 6 is a simplified flow chart illustrating the logic steps performed in determining an additional portion of the pretrip and trip conditions of the present invention.

With reference to FIG. 6, the steps or flow associated with the mid band pretrip and trip conditions will be discussed. Each of the steps or flow in FIG. 6 are performed every clock cycle, which is 12.5 milliseconds (ms) in the preferred embodiment described below. At step 50, the output from the A/D converter 36 for the mid band filter 28 is sampled every clock cycle. Sixty four samples of the mid band signal are captured each clock cycle. In step 52, the highest peak amplitude value (digital) is isolated from the samples in step 50. In step 52, an average peak amplitude value is then calculated from the highest peak amplitude values sent to step 54 each clock cycle from step 52. Although. FIG. 6 shows the average peak amplitude value in step 54 as being calculated just prior to the later testing steps, in a preferred embodiment the average peak amplitude value could be an average peak amplitude value calculated in the previous cycle.

Referring still to FIG. 6, the outputs from steps 52 and 54 are compared in step 56 to determine if a pretrip condition (YES) exists for the mid band filter. For a pretrip condition (YES) to occur in the step 56, for a mid band having a sound pressure range as illustrated in the preferred embodiment above, the mid band highest peak amplitude value is to be greater than about 59 and at least about 2 times greater than the mid band average peak amplitude value. If those conditions occur, that constitutes a pretrip condition (YES) for the mid band.

Still referring to FIG. 6, a special test may be made to compensate for the differences in various glass types. In the special test, the highest peak amplitude value from step 52 from FIG. 6 is compared with the highest peak amplitude value from step 52 for the low band from FIG. 5 to determine if a special condition (YES) exists for the mid band filter. For a special condition (YES) to occur in the step 64 for a mid band having a sound pressure range as illustrated in the preferred embodiment above, the mid band highest peak amplitude value must be greater than the low band highest peak amplitude value by at least a count of about 10.

Still referring to FIG. 6, when a special test YES occurs in step 64, step 66 will save the current average peak amplitude value from step 54 and a count or test is set in a trip condition test in step 66 to look for about 19 more cycles in which the highest peak amplitude value from step 52 is greater than the calculated average peak amplitude value stored from step 54. When a special test NO occurs in step 64, step 68 will store the current average peak amplitude value from step 54 and a count or test is set in a trip condition test in step 68 to look for about 59 more cycles in which the highest peak amplitude value from step 52 is greater than the calculated average peak amplitude value stored from step 54. If either step 66 or step 68 find the correct sequential number of trip conditions, a trip condition YES signal is then sent to step 60 from either step 66 or 68.

With reference to FIG. 5 and FIG. 6 in combination, if a YES trip signal is received in step 60 from all three bands within a specified amount of clock cycles an alarm will occur indicating glass breakage. In the preferred embodiment illustrated above, the step 60 requires a YES trip signal from all three bands within three (3) clock cycles, or 37.5 ms, for an alarm condition to occur. When an alarm condition has occurred, the red light (LED) 40 will blink for 2.5 seconds and then remain on in a steady condition to indicate a past alarm and relay 42 will open for 2.5 seconds.

Figure 7B:
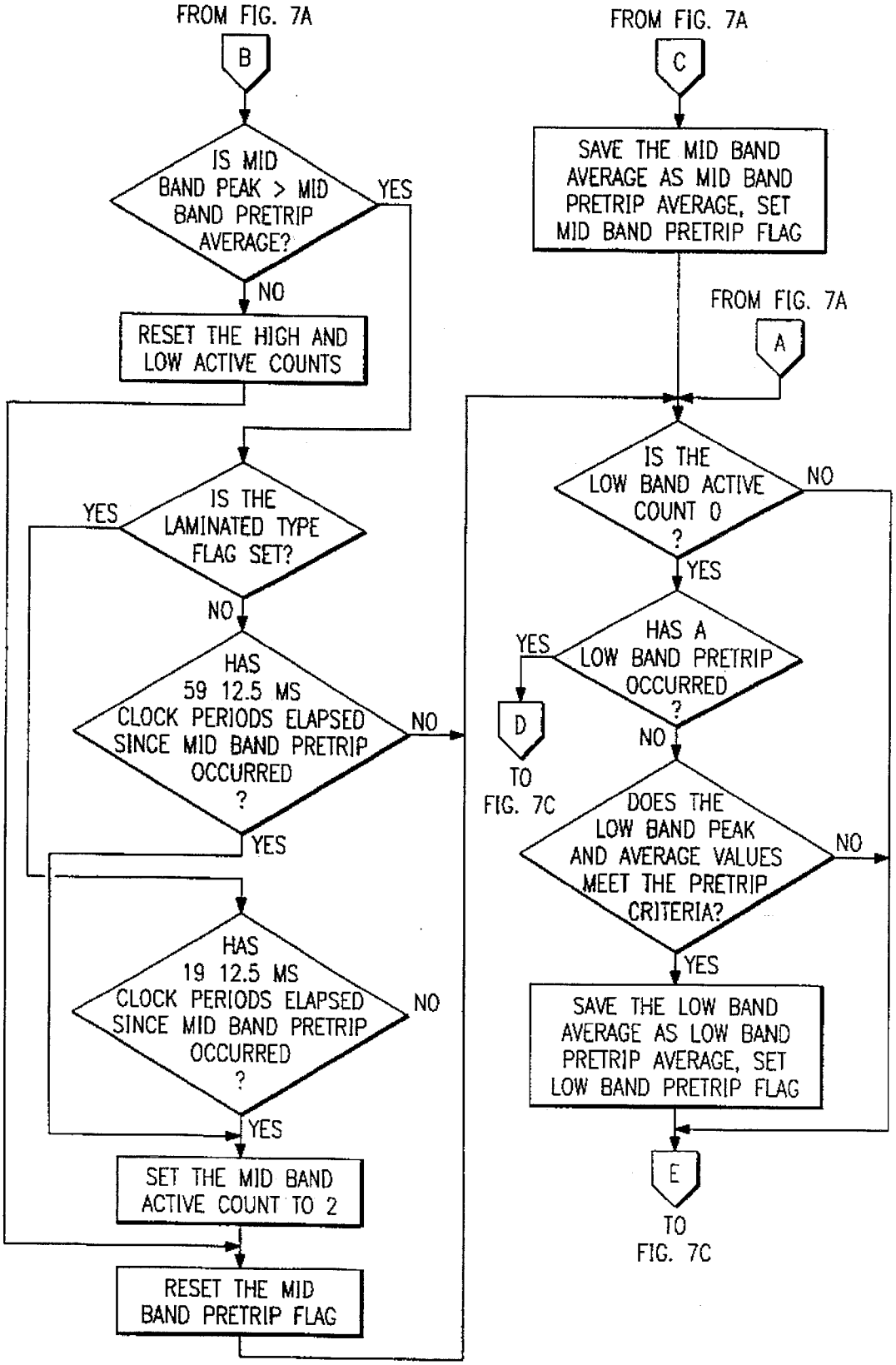
Figure 7C:
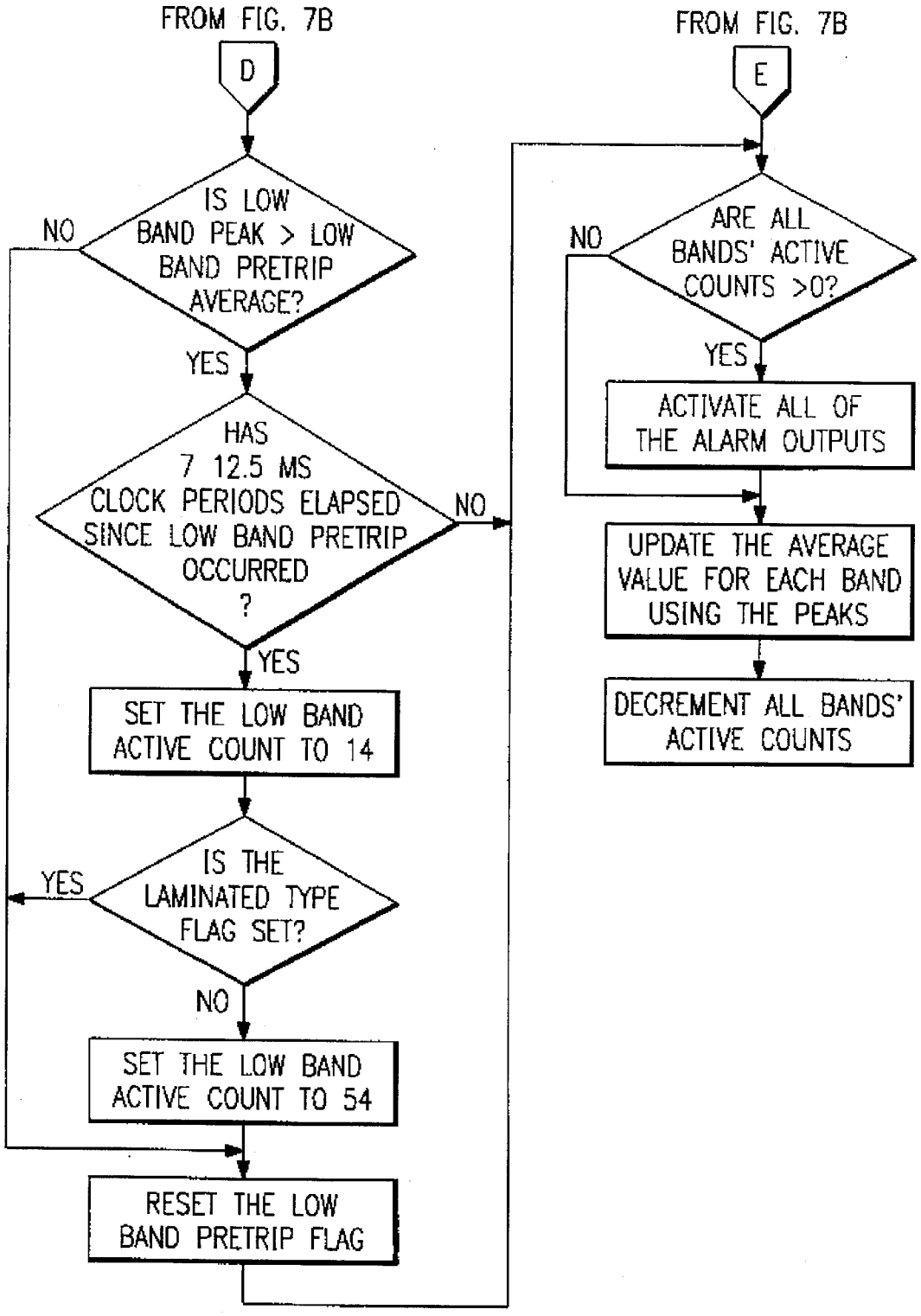

With reference to FIG. 7A–C there is shown a simplified flow chart illustrating the overall program steps of the software which results in the simplified logic steps illustrated in FIG. 5 and FIG. 6. The flow chart in FIG. 7 illustrates the program steps for the embodiment from FIG. 5 and FIG. 6 in which the calculated average peak amplitude is the average peak amplitude calculated in the previous cycle. Those skilled in the art will fully understand and appreciate the simplified flow chart in FIG. 7, and be able to implement those steps.

One advantage of the present invention is the manner in which the average amplitude of the signal in the three bands is created and tracked. In the prior art, this function would require 300 bytes for the three bands. In the present invention, this function is accomplished by using a 2 byte (16 bit) value for each band. The value in the high byte is used as the real 8 bit average value and the lower byte is used as a fractional value. Every 12.5 ms, the value in the high byte is subtracted from the value in the low byte with a possible borrow from the high byte. After that is accomplished, the latest peak value for that band is added to the low byte with a possible carry into the high byte. The net result is an average that is updated at the same rate as the input sample without having to store a large number of previous samples.

Another advantage of the present invention is the real time serial port which outputs data at a 38.4 kbaud rate, 10 bytes every 12.5 ms. The data consists of a start character, the three band's current peak values, the three band's current average values, the I/O ports data, internal flags and parity. This data is useful in developing the actual detection algorithms by sending the data to a computer and recording it in real time for later graphical review and analysis. This procedure is done not only for sounds of glass breaking in different configuration, but also for known false alarm sources of sounds in order to set detection parameters in the invention that would not allow false alarms. In addition, this data is used in production to verify the three filters' characteristics by injecting specific tones into the microphone and reading each of the band's peak values.

A multipurpose test mode is used for verifying range on hookup. The installer would mount the glass break detector 10 in the room and hookup power and relay terminals. The installer would then press the test button 46 which will cause the red light (LED) 40 and the green light (LED) 44 to flash alternately at a fast rate. At this time, the detector 10 is only looking for the proper pretrip condition and duration in the mid band. If the installer activates a glass break simulator within range of the detector 10, both the red light 40 and the green light 44 will come ON and relay 42 will open for 2.5 seconds. The detector 10 can continue, to be tested in this fashion for five minutes after which time the detector 10 will automatically return to normal operation.

If the test button 46 was pressed again during the mid band test mode, the red light 40 and the green light 44 will slow their flash rate and restart the 5 minute time. The detector 10 is now only looking for the low band conditions. The installer can verify operation by sharply striking a hollow wall, door, or ceiling. The next time the test button 46 is pressed, the detector 10 will return to normal operation.

If enabled, the green light 44 will remain ON as long as power is applied to the detector 10, however, if the mid band has a pretrip condition for the proper length of time, the green light 44 will turn OFF for one second. This is used as a 'warm fuzzy' indicator for the end user.

From the foregoing, it will be apparent that the glass break detector of the present invention is exceedingly effective to reduce the number of false alarms while still detecting the breaking of glass with great reliability. Adjustments are not necessary for various types and sizes of glass. The glass break detector can monitor and display what the detector actually senses and at what threshold that the detector triggers an alarm.

Although the present invention has been described with reference to a presently preferred embodiment, it will be appreciated by those skilled in the art that various modifications, alternatives, variations, etc. may be made without departing from the spirit and scope of the invention as defined in the appended claims.

What is claimed is:

1. A method of detecting breaking glass, comprising the steps of:

a) detecting the occurrence of acoustic waves characteristic of breaking glass and providing an output signal;

b) feeding the output signal to a plurality of parallel filters;

c) converting the outputs of the plurality of parallel filters to digital format;

d) determining the peak amplitude value of the output for each of the plurality of parallel filters over a first predetermined time period;

e) determining the average value of the output for each of the plurality of parallel filters over the first predetermined time period;

f) generating a pretrip condition signal for each of the parallel filters when the respective peak amplitude values of the filters exceeds their respective average values during the first predetermined time period by an amount which is predetermined for each filter;

g) generating a trip condition signal for each of the filters when the corresponding pretrip signals are generated for each of a sequential number of the first time periods, the sequential number of first time periods being predetermined for each of the filters; and h) generating an alarm signal indicative of breaking glass when the trip condition signals for all of the filters have been generated within a second predetermined time period.

2. The method of claim 1 wherein said plurality of parallel filters comprises a low band filter, a mid band filter and a high band filter.

3. The method of claim 2 wherein said high band filter comprises a highpass filter set to a peak gain of approximately eleven with a cutoff at approximately 15000 hz.

4. The method of claim 3 wherein the high band peak value must be greater than a predetermined value and greater than the high band average value before a pretrip condition will be generated for the high band filter.

5. The method of claim 2 wherein said low band filter comprises a low frequency bandpass filter set to a peak gain of approximately ten centered at approximately 20 hz.

6. The method of claim 2 wherein said mid band filter comprises a mid frequency bandpass filter set to a peak gain of approximately nine centered at approximately 4500 hz.

7. The method of claim 2 wherein the peak amplitude value of the output of the mind band filter must be greater that the peak amplitude value of the output of the low band filter.

8. The method of claim 1 wherein the first predetermined time period comprises approximately 12.5 milliseconds.

9. The method of claim 1 wherein the second predetermined time period comprises approximately 37.5 milliseconds.

10. The method of claim 1, wherein said step of determining the peak amplitude value includes converting said peak amplitude value to an eight bit latest peak value, and wherein said step of determining the average value includes the steps of:

subtracting from a low byte of a two byte word having an eight bit high byte and an eight bit low byte, the value of the high byte, with any borrow from the high byte of the two byte word;

adding the latest peak value to the low byte of the two byte word, with any carry added into the high byte of the two byte word;

storing the two byte word with the high byte representing the determined average value.

11. Apparatus for detecting breaking glass, comprising:

transducer means for detecting airborne-transmitted sounds and providing an output analog signal;

filter means responsive to the output analog signal and operative to output multiple bands of signals, each band of signals of the multiple bands of signals having frequencies within a predetermined range of frequencies;

converter means responsive to each band of signals to convert each band of signals from analog to digital;

signal processing means responsive to each band of signals received from the converter means and operative to determine the peak amplitude value of each band of signals over a first predetermined time period, to determine the average value of each band of signals over the first predetermined time period, to compare the peak amplitude value of each band of signals to the average value of the respective each band of signals over the first predetermined time period, generating a pretrip condition for each band of signals when the peak amplitude value is greater than the average value by a predetermined amount for each band of signals, generating a trip condition signal for each band of signals when the pretrip signal is generated for each of a sequential number of the first time periods, which is predetermined for each filter, and generating an alarm signal indicative of breaking glass when the trip condition for each band of signals has been generated within a second predetermined time period.

12. The apparatus of claim 11 wherein said filter means comprises a low band filter, a mid band filter and a high band filter.

13. The apparatus of claim 12 wherein said mid band filter comprises a mid frequency bandpass filter set to a peak gain of approximately nine centered at approximately 4500 hz.

14. The apparatus of claim 13 wherein the mid band peak value must be greater than a predetermined value and greater than the mid band average value before a pretrip condition will be generated for the mid band filter.

15. The apparatus of claim 12 wherein said high band filter comprises a highpass filter set to a peak gain of approximately eleven with a cutoff at approximately 15000 hz.

16. The apparatus of claim 15 wherein the high band peak value must be greater than approximately twenty-four and at least approximately a count of ten greater than the high band average value before a pretrip condition will be generated for the high band filter.

17. The apparatus of claim 12 wherein said low band filter comprises a low frequency bandpass filter set to a peak gain of approximately ten centered at approximately 20 hz.

18. The apparatus of claim 12 wherein the signal processing means comprises a microprocessor.

19. The apparatus of claim 18 wherein said microprocessor includes a real time serial port which outputs ten bytes of data every 12.5 milliseconds, said data comprises of a start character, the current peak values and the current average values of the low band, the mid band and the high band.

20. The apparatus of claim 11 further including a generally circular housing comprising a front portion having a predetermined number of concentric circular openings separated by concentric circular portions of said generally circular housing with the centerline of said concentric circular openings in line with the acoustic transducer to focus the airborne-transmitted sounds of breaking glass at the acoustic transducer.

21. The apparatus of claim 20 wherein said predetermined number of concentric circular openings comprises five.

22. The apparatus of claim 20 wherein the first concentric circular opening from the centerline has an inner radius of 0.50 inches measured from said centerline.

23. The apparatus of claim 20 wherein said predetermined number of concentric circular openings each have a radial width of 0.05 inches.

24. The apparatus of claim 20 wherein said concentric circular portions of said generally circular housing each have a radial width of 0.05 inches.

25. The apparatus of claim 20 wherein said generally circular housing has an outer diameter of 4.20 inches.

26. The apparatus of claim 11 wherein the first predetermined time period comprises approximately 12.5 milliseconds.

27. The apparatus of claim 11 wherein the second predetermined time period comprises approximately 37.5 milliseconds.

* * * * *

UNITED STATES PATENT AND TRADEMARK OFFICE

CERTIFICATE OF CORRECTION

PATENT NO. : 5,543,783

DATED : Aug. 6, 1996

INVENTOR(S) : Clark et al.

It is certified that error appears in the above-indentified patent and that said Letters Patent is hereby corrected as shown below:

| | |
|---|---|
| Column 3, line 25 | Replace "preset"<br>With --present-- |
| Column 3, line 33 | Replace "there"<br>With --thereof-- |
| Column 3, line 40 | Replace "FIG."<br>With --FIGS.-- |
| Column 3, line 40 | Delete "is" |
| Column 7, line 8 | Replace "FIG."<br>With --FIGS.-- |
| Column 7, line 58 | Delete the comma after "continue" |
| Column 8, line 67 | Replace "mind"<br>With --mid-- |

UNITED STATES PATENT AND TRADEMARK OFFICE

CERTIFICATE OF CORRECTION

PATENT NO. : 5,543,783

DATED : Aug. 6, 1996

INVENTOR(S) : Clark et al.

It is certified that error appears in the above-indentified patent and that said Letters Patent is hereby corrected as shown below:

Column 10, line 23 Delete "of"

Signed and Sealed this

Tenth Day of June, 1997

*Attest:*

Bruce Lehman

BRUCE LEHMAN

*Attesting Officer*

*Commissioner of Patents and Trademarks*